US005390652A

United States Patent [19]

Minneman et al.

[11] Patent Number: 5,390,652

[45] Date of Patent: Feb. 21, 1995

[54] DUAL THROWER

[75] Inventors: Steven W. Minneman, Clayton; Michael C. Minneman, Englewood, both of Ohio

[73] Assignee: MTM Molded Products Company, Dayton, Ohio

[21] Appl. No.: 971,073

[22] Filed: Nov. 3, 1992

[51] Int. Cl.[6] ..... F41J 9/28; F41B 3/04

[52] U.S. Cl. ..... 124/5; 124/43

[58] Field of Search ..... 124/4, 5, 42, 43

[56] References Cited

U.S. PATENT DOCUMENTS

| | | | |
|---|---|---|---|
| 831,365 | 9/1906 | Masel | 124/43 |
| 1,306,393 | 6/1919 | Sibley | 124/5 |
| 1,445,371 | 2/1923 | Vickery | 124/43 X |
| 1,607,874 | 11/1926 | Darton | 124/5 |
| 3,095,867 | 7/1963 | Kiyuna | 124/5 |
| 3,537,438 | 11/1970 | Reed | 124/5 |
| 4,076,004 | 2/1978 | Huelskamp | 124/5 |
| 4,233,952 | 11/1980 | Perkins | 124/5 |
| 4,347,828 | 9/1982 | Bridgeman | 124/5 |
| 4,730,595 | 3/1988 | Glass et al. | 124/5 |
| 4,974,574 | 12/1990 | Cutlip | 124/5 |

FOREIGN PATENT DOCUMENTS

| | | | |
|---|---|---|---|
| 2321107 | 3/1977 | France | 124/43 |

OTHER PUBLICATIONS

One page Sales Brochure of the MTM Molded Products Company.

*Primary Examiner*—Randolph A. Reese
*Assistant Examiner*—John Ricci
*Attorney, Agent, or Firm*—Biebel & French

[57] ABSTRACT

A disk thrower is disclosed for simultaneously launching two clay targets. The thrower includes two target holders attached to an adjuster which is mounted to a handle for swinging the thrower. The target holders are adjustable along supports formed on the adjuster. A first one of the target holders is arcuately movable along an arc wherein the first target holder is movable relative to a second target holder while lying in a single pane. The second target holder is movable to different positions on the adjuster whereby the second target holder is adapted to lie in different predetermined planes relative to the adjuster and first target holder such that a target held by the second target holder will follow a predetermined convergent, divergent or parallel trajectory relative to a target held by the first target holder.

13 Claims, 3 Drawing Sheets

22
6
18
14
26
30
24
20
16
28
32
36
34
4
4
42
38
12
62
54
10
6

DUAL THROWER

BACKGROUND OF THE INVENTION

The present invention relates to disk holders, and more particularly, relates to a disk holder for throwing multiple disks wherein the trajectory of the disks relative to each other may be adjusted.

The use of hand held disk holders for launching disk-shaped clay pigeon targets for trap shooting is well known, and such holders typically include a target holder attached to a handle by means of a thin flexible neck. The handle may be swung to impart a propelling force to the target held within the target holder and at the end of the swinging motion, the neck and target holder are snapped to cause the target to fly out of the holder. In addition, as the target leaves the holder, the holder frictionally engages a side of the target to impart a spinning motion whereby the target is caused to fly along a trajectory from the holder.

Several trap games employ multiple disks discharged simultaneously such that it is desirable to provide a holder which is capable of holding more than one disk. U.S. Pat. No. 4,974,574 to Cutlip discloses a multiple disk launcher which is adapted to launch two targets simultaneously. The disk launcher includes two spines attached to a single handle wherein each of the spines support a head for holding a respective target whereby two targets may be launched in spaced trajectories from the device. The spines are mounted in fixed relation relative to each other such that the trajectories for the targets launched by this device are not adjustable relative to each other.

Therefore, there is a need for a hand launcher for clay pigeon targets wherein multiple targets may be launched simultaneously, and wherein the trajectories for the targets may be adjusted relative to each other.

SUMMARY OF THE INVENTION

The present invention provides a disk holder for throwing a first target and a second target, the holder comprising a handle supporting a plurality of adjustable target holders for receiving the first and second targets. The plurality of adjustable target holders are adjustable such that the first target is thrown in a predetermined relationship with respect to the second target.

In a further aspect of the invention, the plurality of adjustable target holders for receiving the first and second targets includes an angular support located on an end of the handle and an arcuate support associated with the angular support. A fastener is provided for adjustably fastening a first target holder to the arcuate support and a second target holder to the angular support. The arcuate support includes a plurality of arcuate support positions for supporting the first target holder in a predetermined arcuate relationship with respect to the second target holder. In addition, the angular support includes a plurality of angular support positions for supporting the second target holder in a predetermined angular relationship with respect to the first target holder.

The arcuate adjustment for the first target holder may be used to position the first target holder relative to the second target holder to cause a target held by the first target holder to either lead or lag behind a target held by a second target holder. Alternatively, the targets held by the first and second target holder may be positioned adjacent to each other whereby they will be caused to be released from the holder simultaneously in side-by-side relationship to each other.

The second target holder may be positioned on the angular support to locate a target held by the second target holder in a plane which is non-parallel to a plane of a target held by the first target holder such that the targets will be released with a predetermined angular relationship relative to each other whereby the targets will follow different trajectories. Alternatively, the targets may be positioned lying in planes parallel to each other to follow parallel trajectories.

Thus, it is an object of the present invention to provide a hand launcher for throwing multiple targets wherein holders for the targets may be adjusted relative to each other to vary the trajectory of the targets relative to each other.

Other object and advantages of the invention will be apparent from the following description, the accompanying drawings and the appended claims.

DETAILED DESCRIPTION OF THE PREFERRED EMBODIMENT

Figure 1:
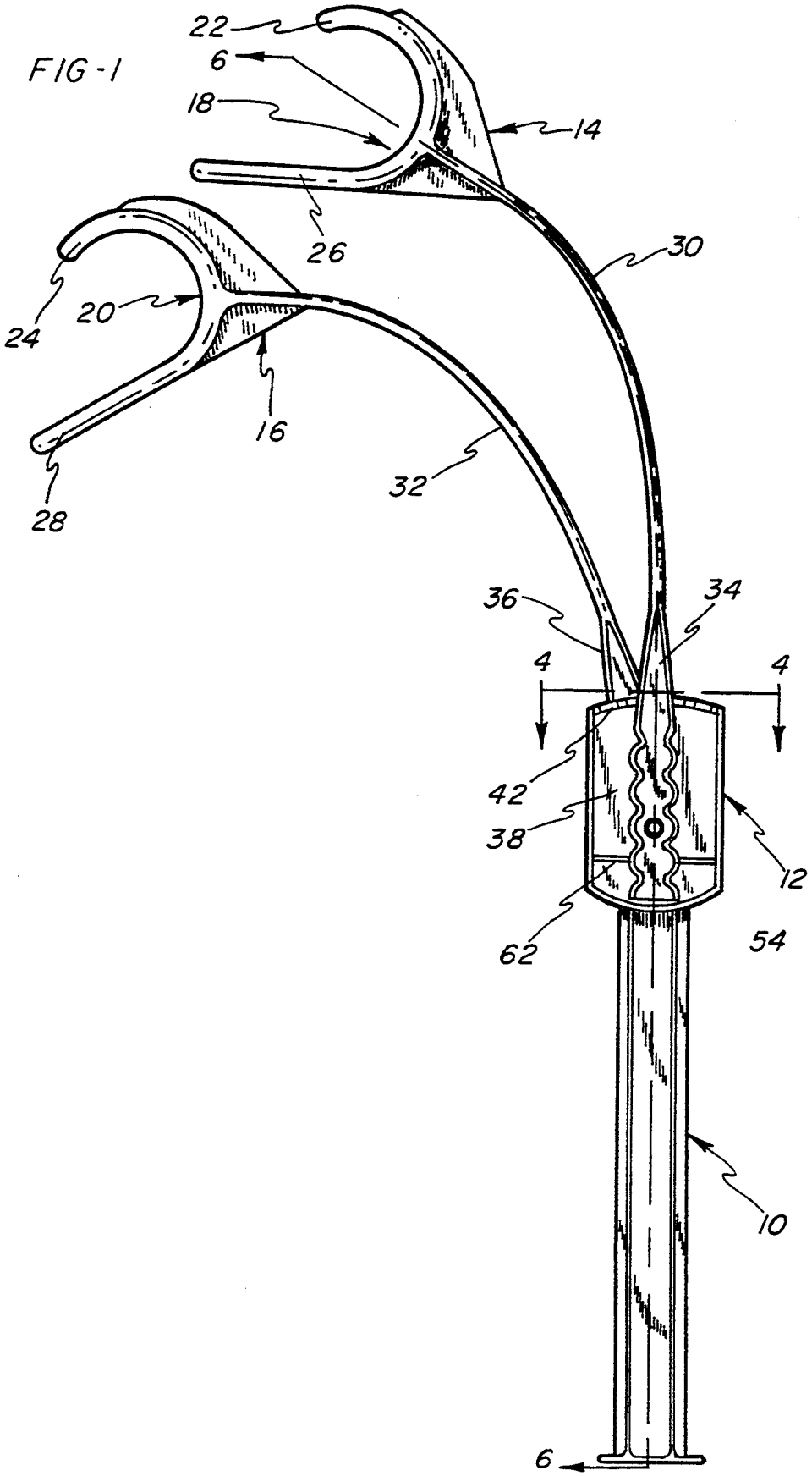
FIG. 1 is a side elevational view of the disk holder of the present invention.

Referring to FIG. 1, the disk holder of the present invention generally includes a handle 10, an adjuster 12 and first and second target holders 14 and 16 wherein the handle 10 and adjuster 12 define a connector between the first and second target holders 14, 16. The target holders 14, 16 are preferably formed as identical structures and each includes a target receiving head portion 18, 20 wherein the head portions 18, 20 are each formed with a respective arcuate leg 22, 24 and a straight leg 26, 28. The head portions 18, 20 function in a conventional manner similar to that described with respect to the multiple disk launcher of U.S. Pat. No. 4,974,574 mentioned above, which patent is incorporated herein by reference.

Each target holder 14, 16 further includes a flexible neck 30, 32 that can be straight or curved defining elongated shafts attached to a respective head portion 18, 20 at one end thereof and including adjuster bar portions 34, 36 at an opposite end thereof. The bar portions 34, 36 are pivotally attached to first and second sides 38, 40 (see also FIGS. 3 and 6) of the adjuster 12.

Figure 2:
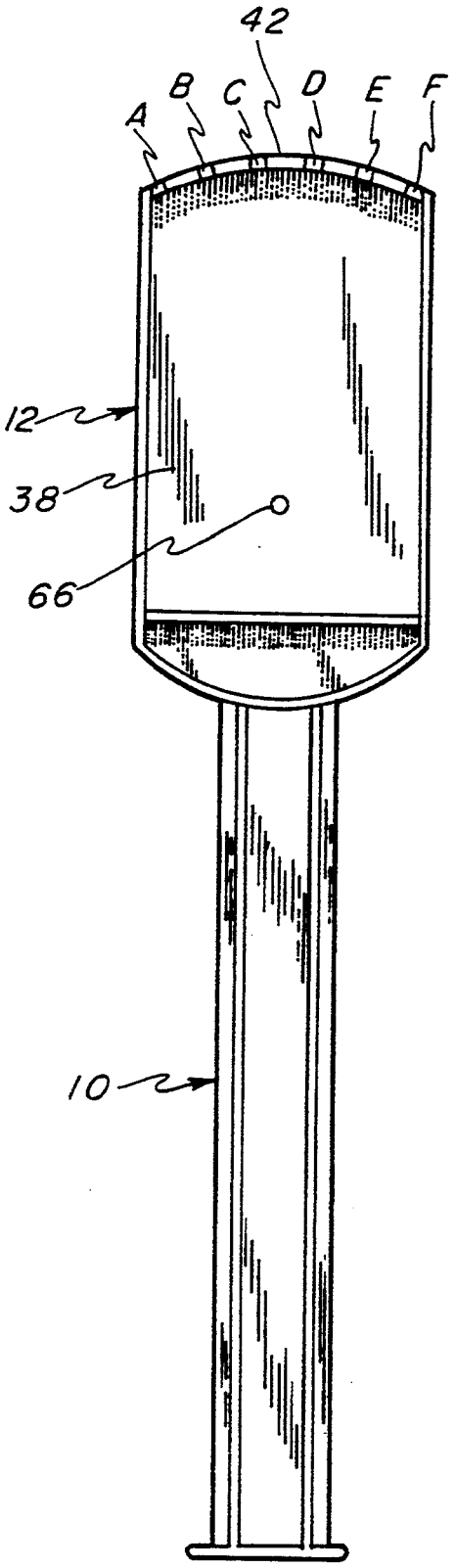
FIG. 2 is a side elevational view showing the handle and arcuate support for the disk holder.
Figure 3:
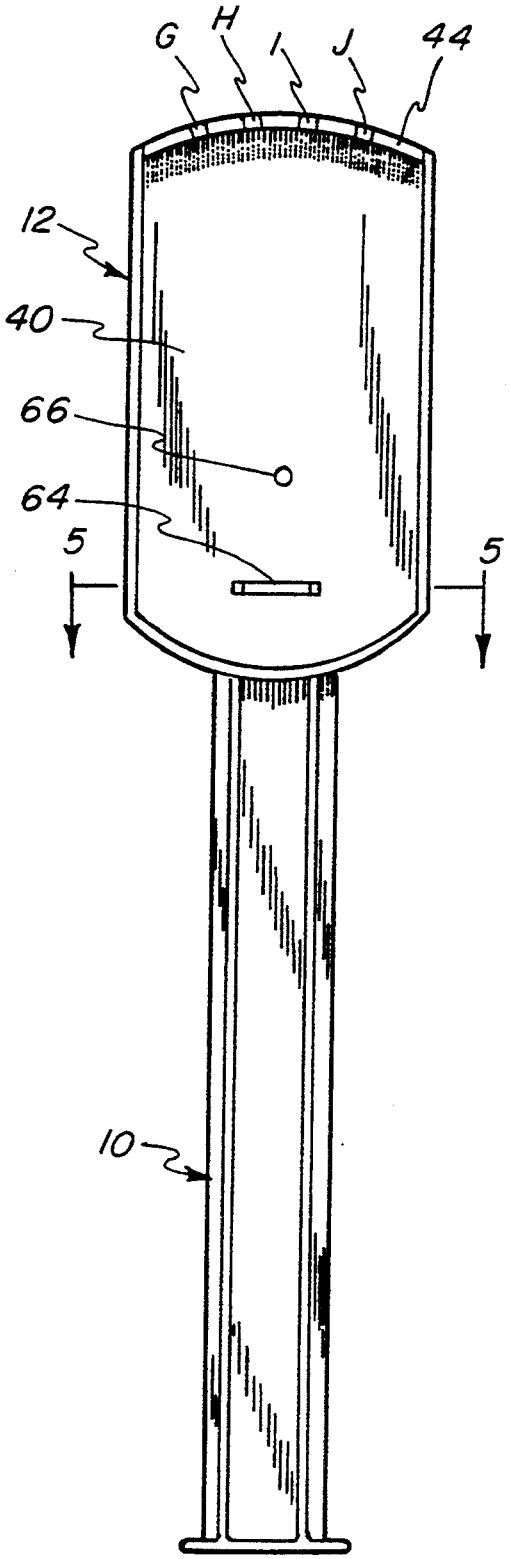
FIG. 3 is a side elevational view showing the handle and angular support for the disk holder.
Figure 4:
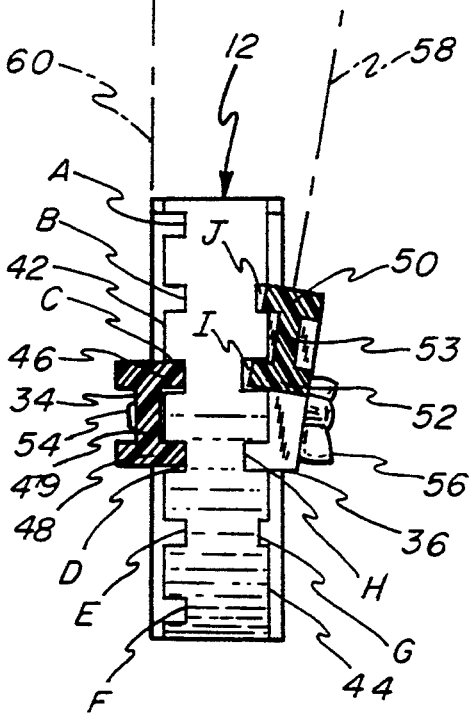
FIG. 4 is a cross-sectional view taken along line 4—4 in FIG. 1.

Referring to FIGS. 2–4, the adjuster 12 includes means defining an arcuate support 42 on the first side 38 and an angular support 44 on the second side 40. The arcuate support 42 includes means defining a plurality of slots A–F adjacent an upper edge of the first side 38. As may be best seen in FIG. 4, the bar portions 34, 36 are formed with an H-shaped configuration wherein the outer edges 46, 48 of the bar portion 34 are adapted to engage within a pair of the slots A–F, and the slots A–F are formed with a substantially uniform depth to maintain a central web portion 49 of the bar portion 34 parallel to the first side 38.

The angular support 44 includes means defining a plurality of slots G–J for receiving edges 50, 52 of the bar portion 36. The slots H and I define a first slot depth for the angular support and the slots G and J define a second depth which is less than the first depth. Thus, a central web portion 53 of the bar portion 36 may be positioned at different angular orientations relative to the second side 40 as a result of being positioned in different ones of the slots G–J, as may be seen in FIG. 4.

The bar portions 34, 36 are pivotally attached to the opposing first and second sides 38, 40 by means of a fastener 54 extending through the bar portions 34, 36 and the adjuster 12. A wing nut 56 is attached to one end of the fastener 54 whereby the bar portions 34, 36 may be quickly loosened from engagement with the supports 42, 44 to move the target holders 14, 16 to different positions.

Figure 6:
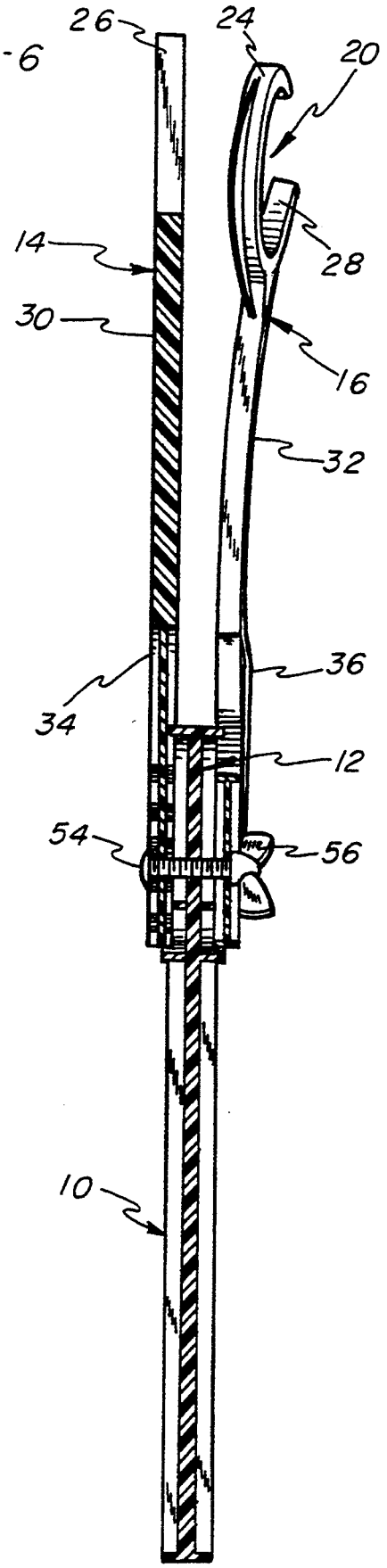
FIG. 6 is an elevational cross-sectional view taken along line 6—6 in FIG. 1.

Referring to FIGS. 4 and 6, it can be seen that by positioning the bar portion 36 such that the edge 50 lies in the slot J and the edge 52 lies in the slot I, the bar portion 36 will be angled outwardly with respect to the bar portion 34 such that the holder 14 lies in a plane defining a trajectory 58 divergent from a trajectory 60 defined by a plane of the holder 16. Alternatively, if the edge 50 of the bar portion 36 is positioned in the slot H and the edge 52 is positioned in the slot G, the holder 14 will be angled to direct a target along a trajectory which converges toward the trajectory 60 defined by the holder 16. In addition, if it is desirable to have the holders 14, 16 define trajectories which are parallel to each other, the bar portion 36 may be positioned in the central slots H and I whereby the holder 16 will lie in a plane parallel to the holder 14.

It should be further noted that by pivoting the bar portion 34 about a pivot axis defined by the fastener 54 into engagement with different ones of slots A–F, the holder 14 is arcuately adjustable along an arc while lying in a single plane defining the trajectory 60. Thus, in addition to the holder 16 being angularly adjustable, the holder 14 is arcuately adjustable such that a target held by the head portion 18 may either lead, lag or be positioned adjacent to a target held by the head portion 20 upon release of the targets.

Figure 5:
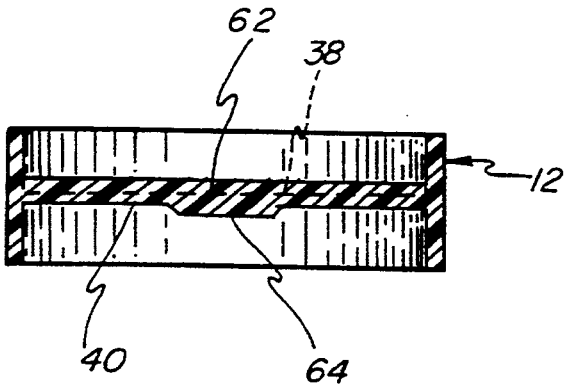
FIG. 5 is a cross-sectional view taken along line 5—5 in FIG. 3.

Referring to FIGS. 2, 3 and 5, it should also be noted that the adjuster 12 is formed with first and second ribs 62, 64. The ribs 62, 64 are located below an aperture 66 for receiving the fastener 54 whereby the ribs 62, 64 engage a lower end of the bar portions 34, 36. The first rib 62 extends outwardly from the first wall 38 to engage the lower end of the bar portion 34 at each of the arcuate positions of the holder 14 whereby the holder 14 is maintained in a single plane regardless of its position.

The second rib 64 extends outwardly from the second wall 40 and is formed such that it will engage the lower end of the bar portion 36 when the edges 50, 52 are located within the slots H and I. However, when the target holder 16 is located in one of its angular positions, such as that shown in FIG. 4, only one of the edges 50, 52 will be engaged with the rib 64 while the other edge is engaged with the second wall 40. Thus, the rib 64 acts to complement the operation of the slots G–H in positioning the bar portion 36 at an angled orientation relative to the second side 40.

From the above description, it should be apparent that the pivoted mounting arrangement for the target holders 14, 16 is such that a first one of the target holders may be positioned at a plurality of arcuate locations about the pivot axis defined by the fastener 54 while maintaining the holder in a single planar orientation relative to the side of the adjuster, and a second one of the target holders may be rotated about the pivot axis defined by the fastener 54 to locate the second holder in an angular orientation relative to the plane of the sides for the adjuster. Thus, the present target holder is adapted to throw plural targets while also providing a variety of trajectories and spacings relative to each other as the targets are released from the holder.

It should also be noted that each of the target holders 14, 16 is of a configuration where each could be operated as a separate thrower for throwing a single target when not attached to the adjuster 12. Further, attachment of the target holders 14, 16 to the unit formed by the adjuster 12 and handle 10 results in a longer swing arm being provided for propelling the targets a longer distance.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A holder for throwing a first target and a second target, comprising:

a handle; and a plurality of adjustable target holders for receiving said first and second targets;

said plurality of adjustable target holders being adjustable such that said first target is thrown in a predetermined relationship with respect to said second target;

said holder further comprising:

an adjuster for adjustably securing said plurality of adjustable target holders to said handle;

said plurality of target holders comprising first holder which lies in a first plane and a second holder which lies in a second plane, respectively, said adjuster comprising at least one support for adjustably supporting said first holder in a predetermined angular position relative to said second holder;

said at least one support comprising an angular support for supporting said first holder in a predetermined angular relationship with respect to said second holder, thereby permitting said first and second targets to be launched at different trajectories.

2. The holder as recited in claim 1 wherein said at least one support further comprises an arcuate support associated with said angular support for supporting said second holder in a predetermined arcuate relationship with respect to said first holder, thereby permitting said first and second targets to be released at different times from said first and second holders.

3. A holder for throwing a first target and a second target, comprising:

a handle; and a plurality of adjustable target holders for receiving said first and second targets;

said plurality of adjustable target holders being adjustable such that said first target is thrown in a predetermined relationship with respect to said second target;

said holder further comprising:

an adjuster for adjustably securing said plurality of adjustable target holders to said handle;

said plurality of target holders comprising a first holder which lies in a first plane and a second holder which lies in a second plane, respectively, said adjuster comprising at least one support for adjustably supporting said first holder in a predetermined angular position relative to said second holder, said at least one support further comprising an arcuate support for supporting said second holder in a predetermined arcuate relationship with respect to said first holder.

4. An adjustable dual holder for throwing a first target and a second target comprising:

a handle;

a first holder;

a second holder; and adjusting means for adjustably coupling said first holder and said second holder to said handle such that said first and second targets may be thrown in a predetermined trajectory;

each of said first and second holders comprising an elongated shaft member having a first end and a second end, said first ends having a target holder thereon; said adjusting means adjustably securing said second ends to said handle, said adjusting means comprising a support associated with an end of said handle for supporting said first and second holders in a predetermined angular and spaced relationship such that said targets may be thrown in said predetermined trajectory;

said support comprising an angular support for supporting said first holder in a predetermined relationship relative to said second holder.

5. The adjustable dual holder as recited in claim 4 wherein said support further comprises an arcuate support for supporting said second holder in a predetermined arcuate relationship with respect to said second holder.

6. The adjustable dual holder as recited in claim 4 wherein said adjustable dual holder further comprises:

fastening means for adjustably fastening said first and second holders to said support.

7. A method for adjustably coupling a first target holder and a second target holder together such that a first target and a second target may be thrown on a first predetermined trajectory and a second predetermined trajectory, respectively, said method comprising the steps of:

(a) positioning a first target holder in operative relationship with a second target holder;

(b) adjusting the relative angle of said first and second target holders; and (c) adjustably securing said first target holder to a second target holder with an adjuster.

8. A method for adjustably coupling a first target holder and a second target holder together such that a first target and a second target may be thrown on a first predetermined trajectory and a second predetermined trajectory, respectively, said method comprising the steps of:

(a) positioning a first target holder in operative relationship with a second target holder; and (b) adjustably securing said first target holder to a second target holder with an adjuster, said adjuster comprising a first angular support, said positioning step comprising the step of:

(a)(1) adjustably positioning the first target holder on said first angular support such that said first target holder is in a predetermined angular relationship with respect to said second target holder.

9. The method as recited in claim 8 wherein said adjuster comprises a second arcuate support, said positioning step comprises the step:

(a)(2) adjustably positioning the second target holder on the second arcuate support such that said second target holder is in a predetermined arcuate relationship with said first target holder.

10. An adjustable connector for coupling a first target holder to a second target holder, said adjustable connector comprising:

a handle;

an arcuate support located on the end of said handle;

an angular support associated with said arcuate support; and a fastener for adjustably fastening said first target holder to said arcuate support and said second target holder to said angular support.

11. The adjustable connector as recited in claim 10 wherein said arcuate support comprises a plurality of arcuate support positions for supporting said first target holder in a predetermined arcuate relationship with respect to said second target holder.

12. The adjustable connector as recited in claim 11 wherein said angular support comprises a plurality of angular support positions for supporting said second target holder in a predetermined angular relationship with respect to said first target holder.

13. The adjustable connector as recited in claim 10 wherein said angular support comprises a plurality of angular support positions for supporting said second target holder in a predetermined angular relationship with respect to said first target holder.

* * * * *